US005390475A

United States Patent [19]

Iwauchi et al.

[11] Patent Number: 5,390,475

[45] Date of Patent: Feb. 21, 1995

[54] PACKAGING METHOD AND APPARATUS THEREFOR

[75] Inventors: Shigeharu Iwauchi; Yoshikazu Morita; Tamotsu Ogiso, all of Tokyo, Japan

[73] Assignee: Mitsubishi Gas Chemical Company, Inc., Tokyo, Japan

[21] Appl. No.: 50,960

[22] Filed: Apr. 22, 1993

[30] Foreign Application Priority Data

Apr. 28, 1992 [JP] Japan ..... 4-028460[U]

[51] Int. Cl.[6] ..... B65B 29/00; B65B 55/00

[52] U.S. Cl. ..... 53/474; 53/111 RC; 53/155; 53/428

[58] Field of Search ..... 53/154, 155, 111 RC, 53/474, 473, 111 R, 428, 135.2, 135.3

[56] References Cited

U.S. PATENT DOCUMENTS

| | | | |
|---|---|---|---|
| 2,956,612 | 10/1960 | Gaines et al. | 154/1.6 |
| 3,864,895 | 2/1975 | Petrea | 53/159 |
| 4,726,171 | 2/1988 | Kreager et al. | 53/410 |
| 4,856,649 | 8/1989 | Inoue | 206/204 |
| 4,907,393 | 3/1990 | Omori et al. | 53/410 |
| 4,995,217 | 2/1991 | Francis, Jr. | 53/474 X |
| 4,996,068 | 2/1991 | Hatakeyama et al. | 426/234 |
| 5,009,308 | 4/1991 | Cullen et al. | 53/474 X |
| 5,084,290 | 1/1992 | Morita et al. | 426/395 |
| 5,085,875 | 2/1992 | Penttila et al. | 426/62 |
| 5,157,902 | 10/1992 | Hatakeyama | 53/492 |

FOREIGN PATENT DOCUMENTS

| | | |
|---|---|---|
| 0257892 | 3/1988 | European Pat. Off. . |
| 0408387 | 1/1991 | European Pat. Off. . |
| 3-56224 | 3/1991 | Japan . |

*Primary Examiner*—James F. Coan

*Attorney, Agent, or Firm*—Leydig, Voit & Mayer

[57] ABSTRACT

The present invention is to provide a method and an apparatus for packaging a substance together with a freshness-keeping agent such as a deoxidizer, wherein, a belt-like member of the deoxidizer bags is cut into individual bags, which successively receive adhesive. Each bag is then supplied to a packaging film to be secured thereto. The packaging film is fed to a packaging machine, at which a substance such as foodstuff is packaged within the film.

31 Claims, 20 Drawing Sheets

PACKAGING METHOD AND APPARATUS THEREFOR

BACKGROUND OF THE INVENTION

1. Field of the Invention

The present invention relates to a method and an apparatus for packaging. More particularly, the present invention relates to a method and an apparatus for packaging a substance by using packaging material such as packaging film, packaging sheets or packaging containers to which a freshness-keeping member is automatically attached to form a package for foodstuffs for example. To be more specific, the present invention relates to securing a freshness-keeping agent to be enclosed within a package for foodstuffs such as confections, coffee, soy bean flour, grain, beans, rice, rice cake, noodles, such as Chinese noodles, ham, salami, sausage and delicacies, and also relates to a method and an apparatus for automatically attaching a freshness-keeping member on the inside of the packaging film or on the cover of a container that forms a package for foodstuffs and the like.

2. Description of the Related Art

Freshness-keeping agents, such as oxygen absorbers or desiccating agents for example, have been placed in a small bag made of gas permeable packaging material (hereinafter referred to as the "freshness-keeping-agent bag"). Conventionally, most of such freshness-keeping-agent bags have been placed within the final package product without being secured thereto.

However, without securing the freshness-keeping-agent bag to the package, it is likely that the consumer will. accidentally eat, or cook the freshness-keeping agent with the foodstuff when the consumer opens the package. The freshness-keeping-agent bags then began to be secured to the package. Although various methods for securing the freshness-keeping-agent bags have been applied, there are problems with each of such methods.

For example, a method for securing the freshness-keeping-agent bag by compressing a sealed portion of the freshness-keeping-agent bag to a sealed portion of the package has been adopted. In this method, however, the surface of the sealed portion of the package is uneven, and thus uniform compression cannot be achieved at the time of sealing. Therefore, air-tightness may not be maintained because the sealing strength is rather weak. In recent years, a method for securing the freshness-keeping-agent bag to the packaging film by using double-coated tape has been developed. This method has durability problems when it is cooked in a micro wave oven and the like because the freshness-keeping-agent bag may fall off the packaging member.

In order to solve the problems concerning heat resistance or bonding strength, and because of the necessity to automate the production of the package, a method to automate the process of securing the freshness-keeping-agent bag to the packaging film by using hot-melt adhesive was proposed in patent application laid-open publication No. Hei 3-56224.

A method for securing the freshness-keeping-agent bag was disclosed in that publication wherein a hot-melt adhesive is dropped on a predetermined position on the inner surface of the packaging film and the freshness-keeping-agent bag is secured to the packaging film on which the hot-melt adhesive is attached.

However, in this method for securing the freshness-keeping-agent bag, if the manufacturer intends to increase production capacity by installing, in a longitudinal or lateral direction, a plurality of packaging machines for automatically producing, by using packaging film, the final package product, an apparatus for dropping the hot-melt adhesive would be necessary for each position of the wrapping film on which the freshness-keeping-agent bag is secured. As a result, not only is an increase of peripheral machines necessary, but a large space for installing such facilities is also required. Improvements have therefore not been obtained.

Moreover, if the processing capability of the packaging machine itself is improved, the speed of supplying packaging material such as packaging film will increase. However, it is difficult to synchronize and match the position on the packaging film for dropping hot-melt adhesive with the freshness-keeping-agent bag.

Among the prior art described above, no significant disadvantage would arise for packaging machines which have a function that would stop the cycle of supplying the packaging material, such as a deep drawing automatic vacuum packaging machine or cup sealer. Recently, there has been a need to attach the freshness-keeping-agent bags without stopping the cycle of the packaging machines. In such packaging machines, it has been extremely difficult to drop the hot-melt adhesive to the predetermined position on the packaging material, and to secure the freshness-keeping-agent bag to the predetermined position.

Furthermore, when the operation of throwing the freshness-keeping-agent bags into the package is performed at places such as a food packaging room where the humidity is high, the sliding capability of the chute that is used to slide the freshness-keeping-agent bags is not favorable, and thus, it has been difficult to steadily supply the freshness-keeping-agent bags at a fixed distance.

It is difficult to change the size of the freshness-keeping-agent bags to match various types of foods because it is burdensome to change the size of the chute in order to match the size of such bags.

In more and more cases of other embodiments of the prior art, a freshness-keeping agent is being used along with a detection agent (such as oxygen detection agent) for detecting the conditions within the package by observing the change of the color of the detection agent, which enables the preservation of the foodstuff by checking whether or not the air-tightness within the non-porous package which contains the foodstuff is being maintained.

Through the use of the detection agent together with the freshness-keeping agent, small holes produced on the surface of a non-porous bag, deficiencies in the seal, or a rise in the oxygen concentration or humidity within the sealed system due to the deterioration of the freshness-keeping capability of the freshness-keeping agent can be determined.

However, conventionally, since the freshness-keeping-agent bag and the detection agent had been separately packaged, if the freshness-keeping agent and the detection agent were enclosed together within the package of foodstuff, the operational efficiency was poor because it required much labor. Moreover, it is difficult to find the detection agent even though it is placed within the package of food because it is small, and moreover, it takes time to recognize the conditions within the package. Because the freshness-keeping agent and detection agent are not secured to the package, the problem still remains that the consumer may eat or cook the freshness-keeping agent or detection agent with the food after opening the package.

In order to solve these problems, the object of the present invention is to provide a method and an apparatus for packaging a substance, wherein, when the freshness-keeping-agent bag is secured to a belt-like member, such as a belt-like member of the packaging material or a belt-like member of the detection agent, there is no or very little variation in the secured position and wherein the synchronization and matching of the freshness-keeping-agent bag with a belt-like member is rather easy.

Another object of the present invention is to provide a method and an apparatus for packaging a substance by using the packaging film to which a freshness-keeping-agent bag is attached, wherein, if the production capacity of the packaging machine for automatically producing the final package product is improved, or if production capacity is increased by installing a plurality of such packaging machines, problems with regard to an increased number of facilities or space will not arise, moreover, no obstacles will arise in securing the freshness-keeping-agent bags to the packaging film.

Another object of the present invention is to provide an apparatus for packaging that is capable of constantly supplying the freshness-keeping-agent bags in an uniform distance, wherein the sliding capacity of the chute is favorable.

Another object of the present invention is to provide an apparatus for packaging for which it is not necessary to change the chute even if the size of the freshness-keeping-agent bag varies.

Another object of the present invention is to provide a method and an apparatus for packaging by which the operation of enclosing the freshness-keeping-agent bag and the detection agent within the package is simplified, the detection agent within the package can be quickly recognized and which prevents accidents such as the consumer eating the freshness-keeping agent or detection agent upon opening the package.

SUMMARY OF THE INVENTION

The inventor noticed that the problems in the prior art lie in the fact that individual freshness-keeping-agent bags are secured to the packaging film at a position where adhesive is applied to the packaging film in advance. By changing the concept behind the prior art, in the present invention, adhesive is applied to the freshness-keeping-agent bags and such freshness-keeping-agent bags are transferred to the line for supplying the packaging material and are secured to the packaging material.

In other words, the present invention is a method of automatically attaching freshness-keeping-agent bags to a belt-like member comprising the following steps: supplying a belt-like member; applying adhesive to a plurality of freshness-keeping-agent bags, each containing a freshness-keeping agent; successively supplying each bag on which the adhesive has been applied to the supply line of the belt-like member; and pressing each the bag to the belt-like member with the adhesive therebetween.

For example, the plurality of freshness-keeping-agent bags is formed into a belt-like shape. The aforementioned belt-like member is, for example, a belt-like member of the packaging material or a belt-like member of the detection agents formed into a belt-like shape.

The preferred embodiment of the present invention comprises the following steps or means of supplying a belt-like member of freshness-keeping-agent bags in which a plurality of freshness-keeping-agent bags are connected into a belt-like shape: supplying a belt-like member of packaging material; applying adhesive to the belt-like member of freshness-keeping-agent bags; cutting the belt-like member of freshness-keeping-agent bags into individual freshness-keeping-agent bags; guiding each freshness-keeping-agent bag toward the supplying line of the belt-like member of packaging material; pressing each freshness-keeping-agent bag to the belt-like member of packaging material with adhesive therebetween; and packaging a substance to be separately supplied by using the belt-like member of packaging material on which at least one of the freshness-keeping-agent bags is attached.

The cutting operation of the belt-like member of freshness-keeping-agent bags into individual freshness-keeping-agent bags may be performed before or after the application of adhesive to the belt-like member of freshness-keeping-agent bags.

The packaging method and the apparatus therefor of the present invention comprises a sorting step or a sorting means wherein the freshness-keeping-agent bags that have already been cut are sorted into one of a plurality of carriage routes, and are to be guided toward the supplying line of the belt-like member of packaging material.

In the packaging method and apparatus of the present invention, each freshness-keeping-agent bag is caused to slide toward the supply line of the belt-like member of packaging material. Each freshness-keeping-agent bag is temporarily stopped while it is sliding down, and is caused to slide again after a predetermined period. It is thus possible to synchronize supplying each freshness-keeping-agent bag with the packaging of a substance.

The adhesive application may be performed while the freshness-keeping-agent bag is temporarily stopped.

The packaging apparatus according to the present invention includes a chute adapted for sliding each freshness-keeping-agent bag toward the supply line of the belt-like member of packaging material. The chute comprises a shutter or a stopper for temporarily stopping the freshness-keeping-agent bag.

In the packaging method and the apparatus thereof, all of the steps in the packaging line are synchronized with the packaging of the substance, i.e. the motion of the packaging machine.

The means for applying adhesive to said belt-like member of freshness-keeping-agent bags in the present invention comprises an adhesive ejection mechanism to eject adhesive, or a dropping mechanism for dropping adhesive, and a means for cutting a belt-like member of freshness-keeping-agent bags or a belt-like member of freshness-keeping-agent bags with a belt-like member of detection agents comprises a cutter placed at the upstream or downstream side of the adhesive application mechanism.

The pressing of the belt-like member of freshness-keeping-agent bags to the belt-like member of packaging material via adhesive therebetween, is performed through a compression means, and the compression means a roller adapted for pressing the belt-like member of freshness-keeping-agent bags to the belt-like member of packaging material.

The chute comprises a sliding surface whose friction is lowered by, for example, attaching tapes whose coefficient of friction is low, such as fluorine-contained resin tape, to the sliding surface; coating the sliding surface with low friction material, such as fluorine-contained resin; providing wires on the sliding surface in a rail form; or forming the tapes whose coefficient of friction is low or low friction coating on the wire. Thereby, the chute obtains a favorable sliding performance and it allows the steady supply of freshness-keeping-agent bags in a uniform distance.

The chute is, for example, branched into plural passages in the longitudinal direction, and comprises a means for adjusting the width of divided passages having reverse screws and handles therefor. The width of the chute is adjustable by using air cylinders, motors or cam mechanisms, or manually, thereby it may easily respond to the change of the width of the freshness-keeping-agent bags.

The chute further comprises a stopper at its end, which is, for example, capable of stretching in the longitudinal direction, and allows the adjustment of the position of the freshness-keeping-agent bag, in such manner as to adjust the space between the stopper and the compression roller. This stopper is also adjustable through mechanisms, such as air cylinders, or manually, similar to the operation of the chute. According to the present invention, since adhesive is applied to the freshness-keeping-agent bag, there arises no or very little variation in the securing position when the freshness-keeping-agent bag is bonded to the belt-like member, such as belt-like member of packaging material or detection agents, and thus the synchronization and matching of the freshness-keeping-agent bag with the belt-like member becomes easy.

Furthermore, the present invention solves the problem of limited spaces for installing facilities that has arisen due to the fact that, for example, if a plurality of the packaging machines is installed, an apparatus for applying adhesive to the packaging material must be provided for each packaging material. In other words, only one apparatus for applying adhesive is required because adhesive is applied to the freshness-keeping-agent bag.

Another preferred embodiment of the present invention comprises the following steps or means for: supplying the belt-like member of freshness-keeping agent in which a plurality of freshness-keeping-agent bags is connected in a belt-like arrangement; a second supplying of the belt-like member of detection agents in which detection agents to detect the conditions within the package adapted for packaging a substance together with the freshness-keeping-agent bag are formed into a belt-like arrangement; applying adhesive to the belt-like member of freshness-keeping-agent bags; pressing the belt-like member of freshness-keeping-agent bags to the belt-like member of detection agents via the adhesive therebetween; and cutting the belt-like member of freshness-kept-agent bags with the belt-like member of detection agents into individual freshness-keeping-agent bags with detection agents.

The preferred embodiment further comprises the following steps and means for: a second adhesive application to freshness-keeping-agent bags with detection agents; a third supplying of the belt-like member of the packaging material; guiding each freshness-keeping-agent bag with detection agent toward the supply line of the belt-like member of packaging material; a second pressing of each freshness-keeping-agent bag with detection agent to the belt-like member of packaging material via the second adhesive therebetween; and packaging a substance to be separately supplied by using the belt-like member of packaging material in which at least one freshness-keeping-agent bag with detection agent is attached. In a preferred embodiment, the detection agent is adjacent to the packaging material so that the conditions within the package may be easily observed because the detection agent is visible from the outside.

Therefore, the present invention enables the automatic integration of the freshness-keeping-agent bag and the detection agent. Moreover, it is possible to attach the freshness-keeping-agent bag with the detection agent to the package. The production efficiency is, of course, enhanced, and moreover, it becomes easier to find the detection agent in the package in which the freshness-keeping-agent bag with detection agent is enclosed, and it is possible to promptly detect any abnormal condition within the package. It also prevents accidents such as the consumer eating the freshness-keeping-agent bag and the detection agent.

In the present invention, freshness-keeping agent means at least one,of an oxygen absorber, desiccating agent, carbon dioxide absorber, ethylene absorber or alcohol transpiration agent. The packaging material means, for example, packaging film, packaging sheets or packaging containers.

Furthermore, bonding of the belt-like member of freshness-keeping-agent bags and the belt-like member of detection agent may be performed by using a double-coated tape.

DESCRIPTION OF THE PREFERRED EMBODIMENTS

The embodiments of the invention used to bond freshness-keeping-agent bags to the package is explained below with reference to the drawings. FIGS. 1 to 6 show a first embodiment of the present invention. As an example, foodstuffs are used as a substance in the first embodiment. In particular, the first embodiment illustrates a cup sealer packaging machine used in the final step, and the packaging machine adopts the so-called three line method where the three packaging machines are placed in a lateral direction to the production line, and the double packaging method to produce two finished products during one operation in the direction of the production line.

Figure 1:
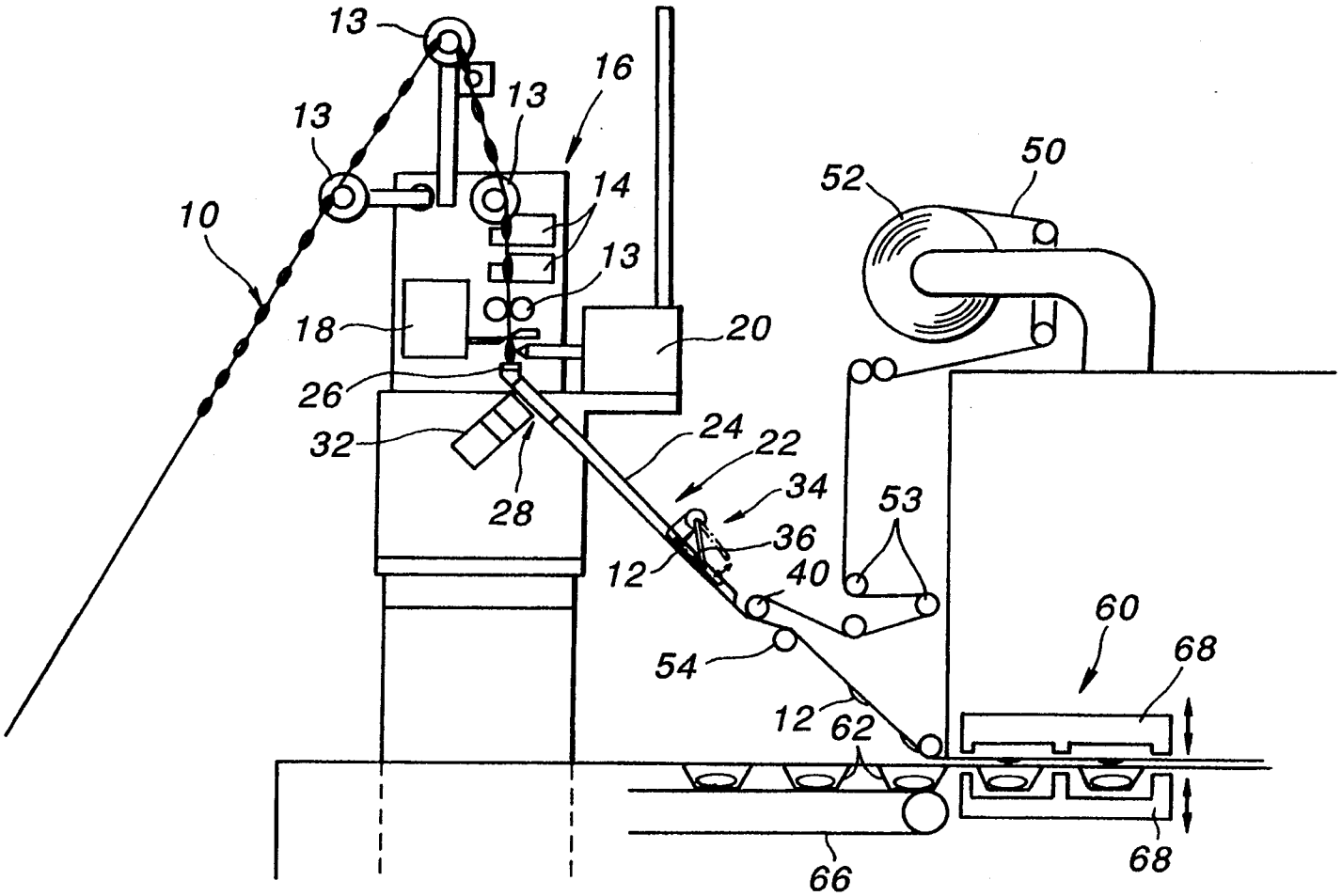
FIG. 1 is a schematic view which illustrates an embodiment for bonding freshness-keeping-agent bags to a packaging material according to the invention.
Figure 2:
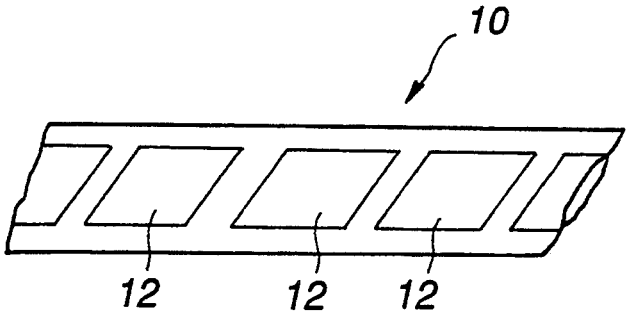
FIG. 2 is a perspective view which illustrates a belt-like member of freshness-keeping-agent bags.

In FIG. 1, which illustrates the first embodiment, reference numeral 10 indicates the belt-like member comprising the freshness-keeping-agent bags, each containing a freshness-keeping agent. The belt-like member comprises a plurality of freshness-keeping-agent bags 12 which are connected in a belt-like shape connected at a heat-seal portion as shown in FIG. 2. The belt-like member of freshness-keeping-agent bags 10 is automatically supplied to the cutter, as explained later, through the supply apparatus 16 including the plurality of rollers 13 and a detector 14 for detecting the heat-seal portion between each freshness-keeping-agent bag in the belt-like member.

The cutter 18 and hot-melt gun 20 are placed to eject adhesive at the lower end of said supply apparatus 16. In the embodiment, the hot-melt gun 20 is located immediately below the cutter 18. However, the hot-melt gun shall not be limited to the above embodiment, and it may be placed above and the cutter 18 may be placed below. The cutter 18 is used for producing individual freshness-keeping-agent bags 12 by cutting the heat-seal portion of the belt-like member 10 provided between each freshness-keeping-agent bag 12 based on the detection result according to the detector 14 of said supply apparatus 16. In the embodiment, the hot-melt adhesive is applied to the surface of the freshness-keeping-agent bags 12 by the hot-melt gun 20, immediately before or after the freshness-keeping-agent bags 12 are cut by the cutter 18 at its lower end. In this operation, the hot-melt adhesive is made from, for example, materials that contain polypropylene or EVA (ethylene-vinyl acetate copolymer) as their main components. Of said materials, a material using polypropylene as its main component satisfies the standards for food additives pursuant to the Food Sanitation Law applicable to foodstuffs which may constitute the substance, and is preferable because of its high softening point and peel strength. The invention does not intend to limit the ejection of hot-melt adhesive by using a hot-melt gun as shown in the embodiment. Any method for applying adhesive may be adopted if adhesive that is capable of bonding the packaging film, as explained later, can be actually applied to the surface of the freshness-keeping-agent bags.

After a single freshness-keeping-agent bag is produced by using the cutter 18 and adhesive is applied to the surface of said bag, the freshness-keeping-agent bags are guided to the supplying line of the packaging film by using the guiding mechanism 22. In the embodiment, the guiding mechanism 22 comprises a chute 24 which causes each freshness-keeping-agent bag 12 to slide to reach a predetermined position by its own weight. The cross-sectional shape of the chute 24 may be quadrangle or ellipsoid. The chute should preferably have a slope of 30 degrees to 60 degrees, or more preferably, should have a slope of 40 degrees to 45 degrees.

Figure 3:
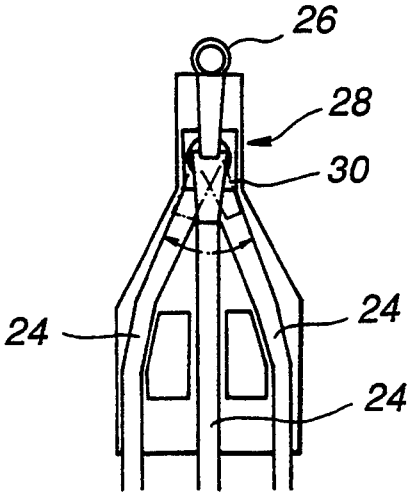
FIG. 3 is a plan view which illustrates the sorting portion of a chute of such embodiment.

Since three packaging machines, as explained below, are placed in a parallel fashion in the production line in this embodiment, the chute 24 is branched into three directions and extends in a parallel manner thereafter. The structure of the chute 24 is also illustrated in FIG. 3. In other words, a single freshness-keeping-agent bag 12 that has already been cut by the cutter 18, drops into a single hopper 26, and is guided to any of the chutes 24 therefrom through the sorting apparatus 28. In the sorting apparatus, a single passage 30 is swiveled to engage with any one of said three chutes by operation of a motor 32, and thereby the freshness-keeping-agent bags are guided to a predetermined chute. The motor 32 operates according to a signal from the packaging machine. The arresting apparatus 34 is placed at the periphery of the lower end of each chute for the synchronization of the supply of the freshness-keeping-agent bags with the motion of the packaging machine. In the embodiment illustrated in FIG. 1, the arresting apparatus 34 takes the form of a shutter 36 which rotates to block the passage of the chute 24. When the shutter 36 is closed as shown by the solid line in FIG. 1, the freshness-keeping-agent bag 12 is blocked and temporarily stopped at such location. The distance between the end of each chute 24 and the temporary bonding roller 40 is short enough that the freshness-keeping-agent bags 12 which have been guided are bonded to the packaging film by compression of the temporary bonding roller 40 according to the thickness of said bag.

Figure 4:
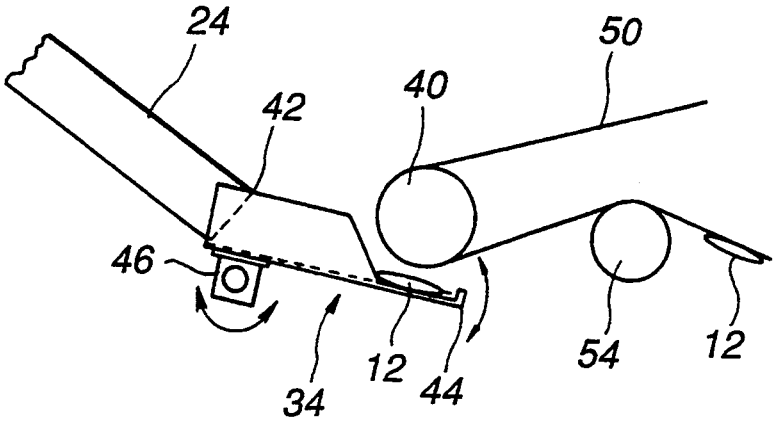
FIG. 4 is a side view which illustrates another example of the arresting apparatus in such embodiment.

FIG. 4 illustrates another embodiment of the end of the chute. In this embodiment, an auxiliary chute 42 is provided at the end of the main body of the chute 24 as an arresting apparatus 34, wherein the top end of the auxiliary chute extends to the periphery of the temporary bonding roller, and which includes a stopper portion 44 that is bent into an L-shape. The auxiliary chute 42 is swiveled relative to the main body of the chute 24 by the motor 46, thereby the freshness-keeping-agent bag 12, which stops at the waiting position by the stopper portion 44, is attached to the packaging film which travels around the temporary bonding roller. By using this auxiliary chute 42, the freshness-keeping-agent bag 12 may be closely secured to the packaging film even if the thickness of the freshness-keeping-agent bag 12 varies.

In FIG. 1, reference numeral 50 indicates the belt-like member of the packaging film that comprises the packaging film extending in the belt-like shape, and is unrolled from the winding roll 52 to which said belt-like member is wound in layers. The belt-like member of the packaging film 50 travels through a plurality of rollers 53 and is rolled at said temporary bonding roller 40. At this place, the freshness-keeping-agent bags are bonded to the belt-like member of the packaging film at a certain distance or specified interval, are pressed to the belt-like member of the packaging film to be firmly attached to the belt-like member of the packaging film through a compression roller, and then the packaging film with freshness-keeping-agent bag is introduced to the packaging machine 60. Preferably, non-gas permeable film that has a heat bonding capacity on the surface forming the inside of the package of the finished product should be used as the packaging film.

Figure 6:
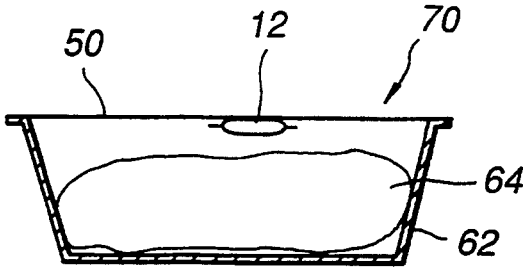
FIG. 6 is a cross-sectional view which illustrates the final package product according to said embodiment.

The packaging machine 60 is a so-called cup sealer packaging machine. As shown in FIG. 1, a so-called double cup sealer by which two packages can be produced at one time in the direction of the production line is used in the embodiment. More particularly, the plurality of the cups 62, which have been produced in advance and connected in a belt-like shape, and which contain the substance 64, is supplied to the packaging machine through the conveyor 66. Within the packaging machine 60, the belt-like member of the packaging film 50 to which freshness-keeping-agent bags 12 are secured, is placed above each cup 62 when two cups 62 are placed at a predetermined position. In such an event, the sending of the belt-like member of the packaging film is temporarily stopped, the upper and lower sealers 68 crimp, and two integrated packages 70 are produced by sealing the periphery of each cup 62 with the belt-like member of the packaging film. Thereafter, although not shown in the drawings, these two packages are cut into individual packages to form the final package as shown in FIG. 6.

The operation of said embodiment is explained below. Since the packaging machine 60 is a so-called cup sealer packaging machine, the sending of the packaging film is temporarily stopped during the sealing steps of the package. Therefore, the entire packaging line may be synchronized with the operation of the packaging machine. In other words, operational timing of the supply line of the belt-like member of the packaging film 50 and the arresting apparatus 34 may be determined so as to be synchronized with the operation of the packaging machine 60.

Figure 5:
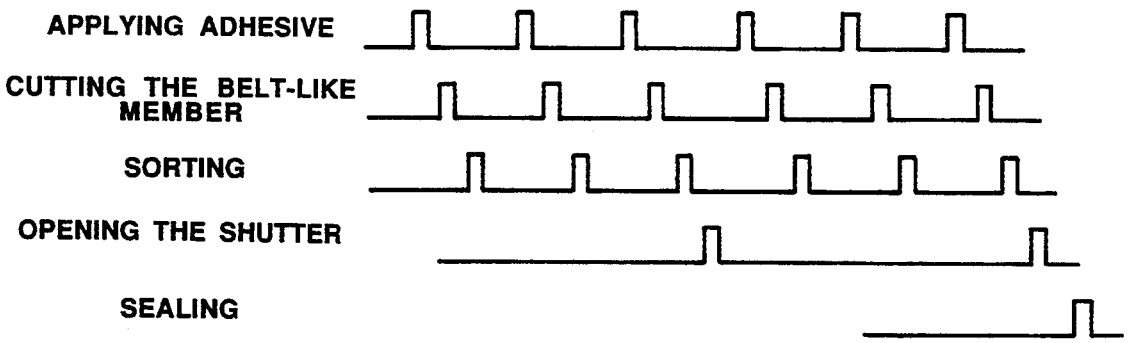
FIG. 5 is a timing chart which shows the timing of each means in such embodiment.

The timing of the major steps is explained by reference to FIG. 5. The belt-like member of the freshness-keeping-agent bags 10 is continuously supplied toward the cutter 18. The movement related to applying the hot-melt adhesive by the hot-melt gun 20 and the movement related to cutting the belt-like member 10 into individual freshness-keeping-agent bags 12 may be continuously performed. In other words, the belt-like member is cut immediately after the application of the hot-melt adhesive to form individual freshness-keeping-agent bags 12, and then the bag 12 is guided to the predetermined chute 24 through the sorting apparatus 28. These operations are continuously repeated three times, and each bag 12 is sorted into three chutes 24. The bags 12 that have been sorted to each chute wait at the arresting apparatus 34. A signal from the packaging machine 60 is directly input, or input after a timing adjustment, to the arresting apparatus 34. The shutter 36 is then opened and each bag 12 reaches the temporary bonding roller 40 where the bag 12 is bonded to the belt-like member of the packaging film 50. In the example shown in FIG. 4, the auxiliary chute 42 swivels so that the bag 12 is secured to the packaging film through compression instead of opening the shutter. Through the above operation, three bags 12 are secured to three places, lined in a lateral direction, on the belt-like member of the packaging film 50. Said belt-like member of the packaging film 50 then travels toward the packaging machine. Moreover, the belt-like member of the packaging film 50 operates in synchronization according to the signal from the packaging machine.

In this embodiment, since the packaging machine 60 seals two connected packages 70 at the same time without detaching them, the operation is continuously repeated twice. The supplying of the packaging film is temporarily stopped when two bags 12 are placed at the packaging machine 60, as shown in FIG. 1, and the simultaneous sealer 68 of the packaging machine 60 operates to seal the entire periphery of the cup 62. The packages are then moved to the cutting steps. The sealing step by the packaging machine is shown in the very bottom column of FIG. 5, however, in the actual operation, the operational timing of each step is determined based on the signal from this packaging machine.

An example of placing three packaging machines in the lateral direction of the line is shown in the embodiment, however, when only one packaging machine is mounted as in the conventional packaging method, the sorting apparatus and the plurality of split chutes will not be necessary. If the entire line is well synchronized, the arresting apparatus will not be necessary either.

Figure 7:
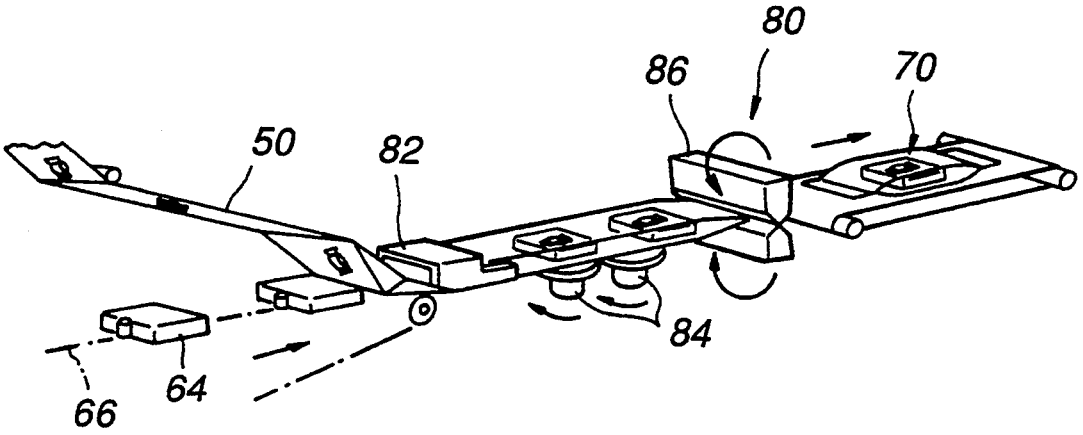
FIG. 7 is a perspective view which illustrates an example of using a side pillow packaging machine in the embodiment for bonding freshness-keeping agents to a packaging material according to the present invention.
Figure 8:
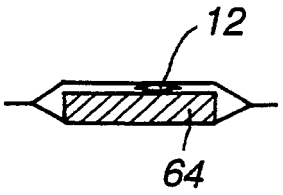
FIG. 8 is a cross-sectional view which illustrates the package where the side pillow packaging machine is used.

FIGS. 7 and 8 illustrate another embodiment of the present invention, which is an example of using the so-called side pillow packaging machine as a packaging machine. The configuration of the apparatus is basically the same as that explained above except for the securing steps to secure individual freshness-keeping-agent bags 12 to the belt-like member of the packaging film 50, and thus the description of this configuration is omitted.

The operation of the packaging machine is explained below. The belt-like member of the packaging film 50 is folded into a substantially cylindrical shape, whereby the longitudinal direction thereof is its axis, by using the bag producer 82 of the side pillow packaging machine 80. The substance to be supplied by the conveyor 66 is automatically enclosed in the cavity created through said folding operation. The overlapping portion at the bottom of the packaging film 50 in a cylindrical shape is sealed by the center sealer 84 disposed at the downstream side of the bag producer 82. Individual substance 64 is sealed into one bag by the top sealer to be placed at the downstream side of said center sealer and is cut off at the same time. As shown in FIG. 8, the package 70, which is the finished product, has a configuration wherein the substance 64 is accommodated within the bag, both ends of which are sealed, and the freshness-keeping-agent bag 12 is secured to the inner surface of the packaging film.

In this embodiment, it is not necessary to stop the supplying of the packaging film because the center sealer 84 continuously seals the center portion along with the movement of the line, and because the top sealer 86, which consists of an upper sealer and bottom sealer, moves in synchronization with the movement of the line by drawing a substantially circular are as shown by the arrow in FIG. 7. Therefore, production efficiency of the packaging machine is relatively high. When such side pillow packaging machine 80 is used, the plurality of such packaging machines are not typically mounted, and thus it is not necessary to provide the plurality of the chutes and other parts in a parallel fashion. However, the invention does not intend to limit itself to such embodiment, and the plurality of the packaging machines may be provided both in a parallel fashion and/or in a series, as described in the first embodiment.

In the above-described embodiments, the cup sealer packaging machine and the side pillow packaging machine are used as the packaging machine. However, the present invention is not intended to be limited to the above embodiments, and other packaging machines such as a reverse side pillow packaging machine in which the center seal portion faces upward in said side pillow packaging machine or the so-called deep drawing packaging machines may also be used.

Another embodiment of chute 24, the arresting apparatus 34 and the apparatus for applying hot-melt adhesive are explained below. The apparatus for dropping adhesive, which is another example of an apparatus for applying adhesive, is configured by a gun and a controller unit, and comprises an automatic control mechanism for controlling the melting temperature of the hot-melt adhesive, the amount of adhesive to be dropped and the timing of the dropping and air cut mechanism.

Figure 9:
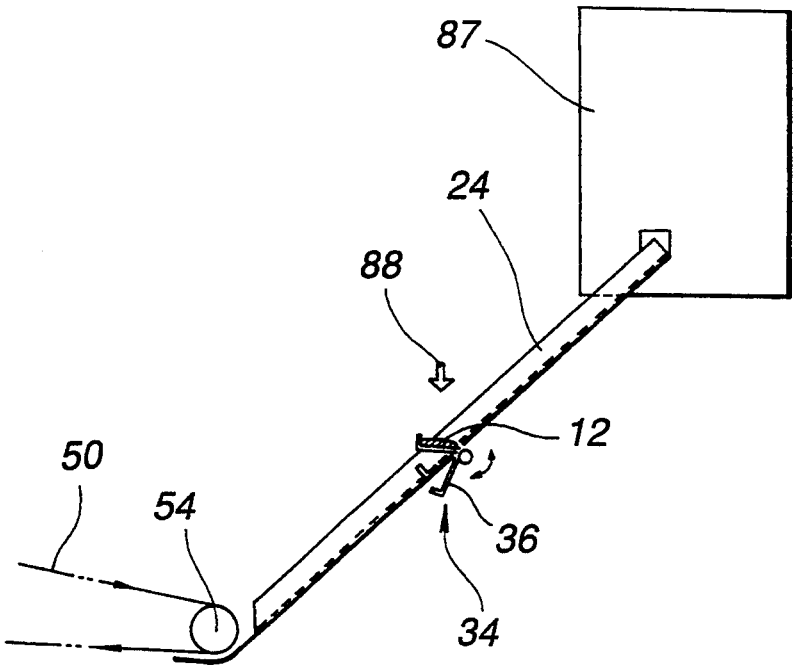
FIGS. 9, 11A and 11B and 12A, 12B and 12C are side views which illustrate another embodiment of a chute and an arresting apparatus.

The belt-like member of freshness-keeping-agent bags 10 that is continuously and automatically supplied is cut into individual freshness-keeping bags 12 by an automatic throw machine 87, as shown in FIG. 9. The individual freshness-keeping bags slide down the chute 24, and are stopped by the shutter 36 in the position shown in FIG. 10A. The shutter 36 places the individual freshness-keeping bags 12 in a substantially flat position (FIG. 10B) where the hot-melt adhesive 88 is dropped on the surface of each individual freshness-keeping bag 12, and then waits for the synchronization signal from the packaging machine. This waiting period is generally three to ten seconds. After receiving the synchronization signal, the shutter 36 is placed in the position shown in FIG. 10C, and the freshness-keeping-agent bag 12 slides down the chute 24 and is then attached to the packaging material 50.

Figure 10A:
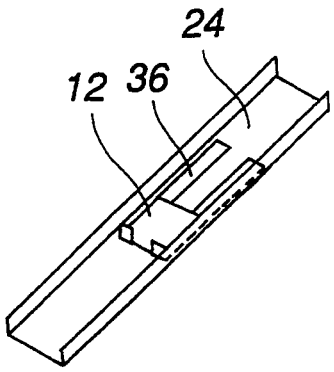
FIGS. 10A, 10B and 10C are perspective views which illustrate another embodiment of a chute and an arresting apparatus.
Figure 10B:
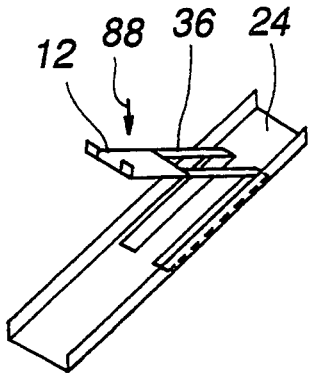
Figure 10C:
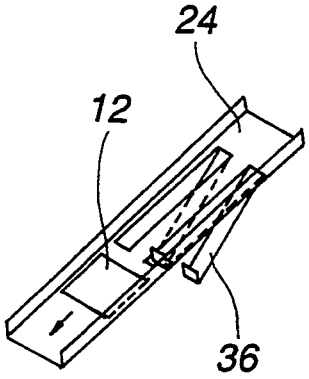

If the hot-melt adhesive is not drippy, the hot-melt adhesive is dropped at the position shown in FIG. 10A, and then the freshness-keeping bag waits for the throw signal that is to be determined by taking the dropping speed based on the synchronization signal of the packaging machine into consideration. After receiving the signal from the packaging machine, immediately after dropping the hot-melt adhesive, the individual-freshness-keeping-agent bags 12 start to slide down the chute 24 (FIG. 10C). The series of operational mechanisms operate, for example, by a driving mechanism such as a motor, air cylinder or cam.

Figure 11A:
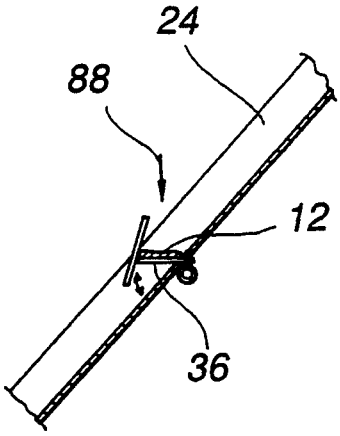
Figure 11B:
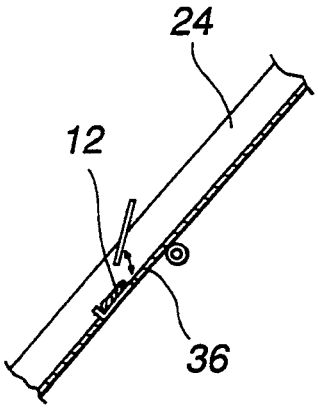

FIGS. 11 and 12 illustrate examples of other shutters 36, which may be used according to the type of the packaging machine. A simplified form of the shutter is shown in FIG. 11A, wherein the shutter auxiliary securing plate 37 is provided at the chute 24, an individual freshness-keeping-agent bag 24 is located at the predetermined position by the use of the shutter, the hot-melt adhesive 88 is dropped thereon, the shutter 36 is opened as shown in FIG. 11B according to the synchronization signal from the packaging machine, the individual freshness-keeping-agent bag slides down, and the bag is attached to the packaging film 50.

Figures 12A, 12B, 12C:
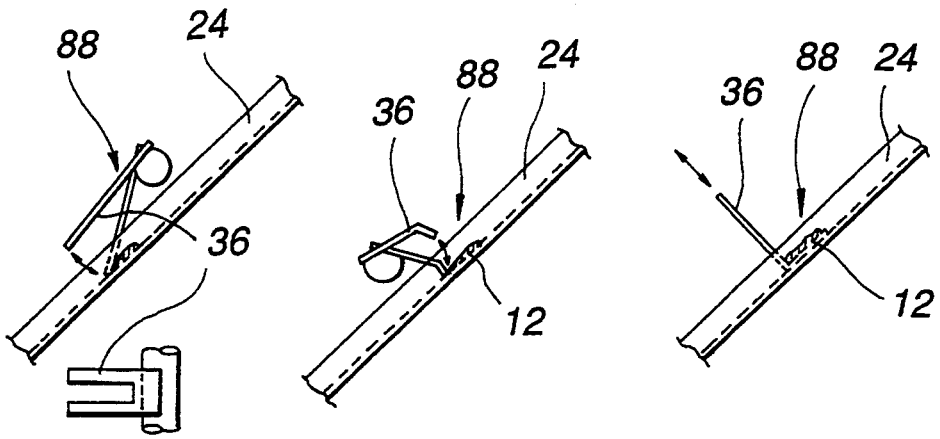

The shutter 36 shown in FIG. 12A is placed above the chute 24, and the plate comprising the shutter 36 is cut out in a substantially centered U-shape, through which hot-melt adhesive 88 may be dropped. In the shutter shown in FIG. 12B, dropping the hot-melt adhesive 88 is made easier by placing the shutter at the downstream side of the chute 24. An alternative shutter 36, i.e. a slide shutter which can be opened and closed as it is moved up and down is shown in FIG. 12C.

Figure 13:
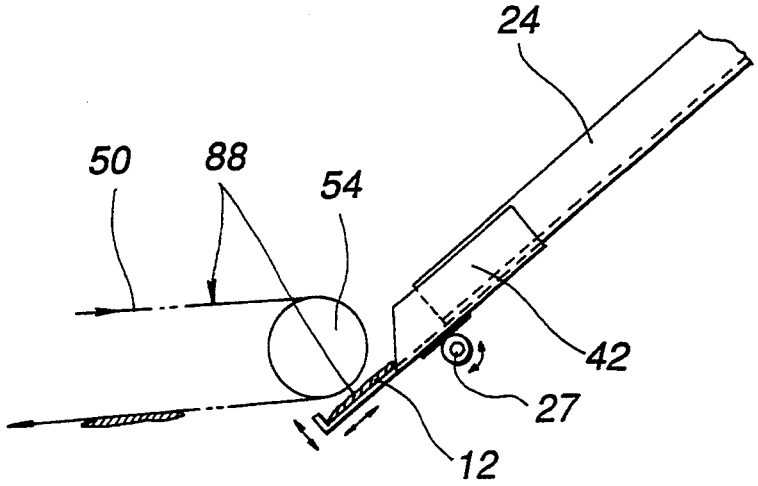
FIGS. 13 and 14 are side views which illustrate an auxiliary chute.

FIG. 13 illustrates another embodiment of the end of the chute 24. In this embodiment, the auxiliary chute 42, as the arresting apparatus explained in FIG. 1, can slide in the longitudinal direction of the chute so that the stopped position of the freshness-keeping-agent bag 12 may be adjusted. Controlling the space between the auxiliary chute 42 and the roller 54 is performed by the rotation of the shaft 27.

Figure 14:
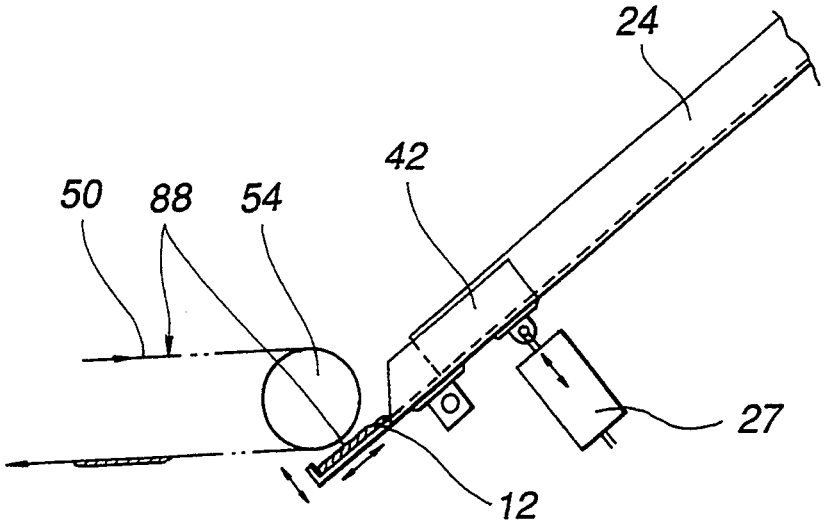

In FIG. 14, a reciprocal driving apparatus, such as an air-driven type or a hydraulic cylinder type, is used as the driving apparatus shown in FIG. 13. Said configuration enables the adjustment of the length of the top-end portion of the chute 24, and the distance between the compression roller 54 and the chute 24, if an individual freshness-keeping-agent bag 12 is secured to the packaging film 50 and when it is necessary to determine the location of said bag.

Figure 15:
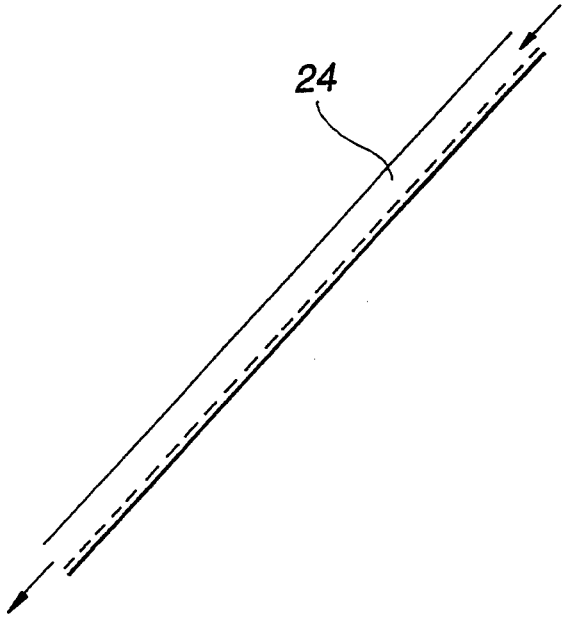
FIG. 15 is a figure which illustrates a chute.
Figure 16A:
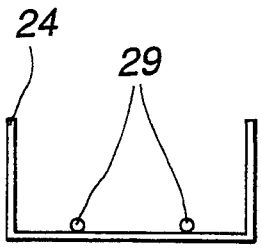
FIGS. 16A, 16B and 16C are cross-sectional views of the chute on which wires are provided.
Figure 16B:
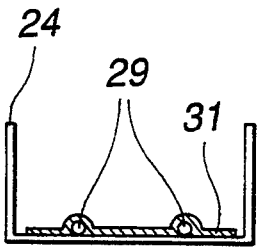
Figure 16C:
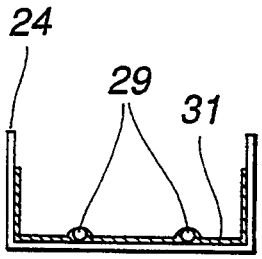

FIG. 15 is a side view of the chute 24. In FIG. 16A, two wires 29 are placed on the inner surface of the chute 24 to facilitate the sliding of the individual freshness-keeping-agent bags 12. Typically, wires having a diameter of 1.0 mm to 4.0 mm are used. Two or three wires may be used depending on the size of each freshness-keeping-agent bag to obtain a similar effect. In FIG. 16B, low friction tape, such as fluoroplastic tape is attached, or fluoroplastic resin coating is placed on a portion of the bottom surface of the chute 24. In FIG. 16C, low friction tape 31 or low friction coating is also placed on the side of the chute 24 in FIG. 16B. Such configuration allows a stable supply of the freshness-keeping-agent bags 12 even at places of high humidity.

Figure 17:
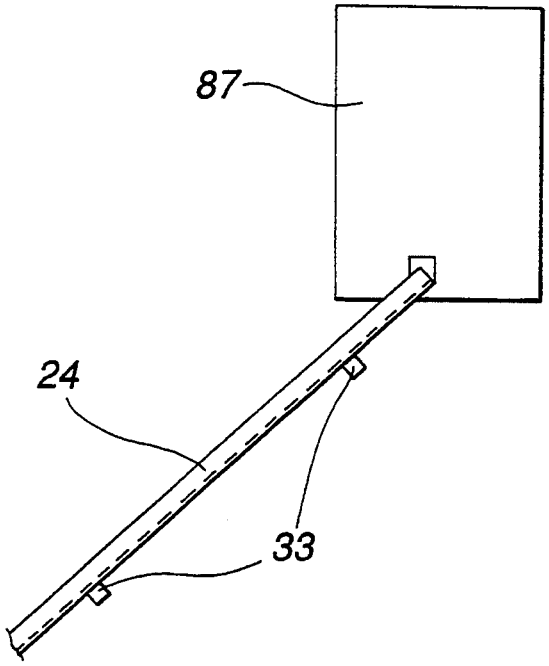
FIG. 17 is a side view of another embodiment of the chute.
Figure 18A:
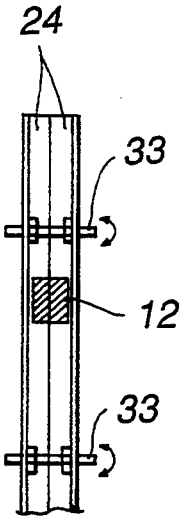
FIGS. 18A and 18B are front views of another embodiment of the chute.
Figure 18B:
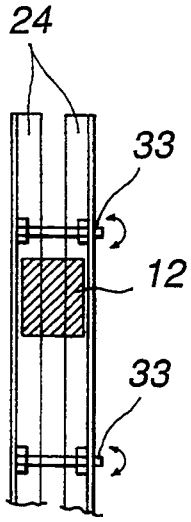

FIG. 17, 18A and 18B illustrate an adjustment apparatus for easily adjusting the width of the chute 24 to match different widths of freshness-keeping-agent bags 12. FIG. 17 is a side view of the entire apparatus, and FIG. 18A is a plan view showing the condition where the chute 24 is adjusted to match the size of a small-sized freshness-keeping-agent bag 12. FIG. 18B illustrates the condition where the chute 24 is adjusted to match a larger-sized freshness-keeping-agent bag 12. The width of the chute, which is formed by a pair of chute segments, may be easily adjusted by operating reverse screws 33, each of which is screwed laterally into the chute segments.

As explained above, according to the present invention, the mechanism for supplying the packaging film may be applied by a continuously operated cup sealer. Furthermore, it enhances the accuracy in determining the placement of the freshness-keeping-agent bags. In the present invention, adhesive is applied to the freshness-keeping-agent bags, instead of applying adhesive to the packaging film as in the prior art. This eliminates the necessity for providing apparatuses for applying adhesive and accessories thereof for each packaging machine as in the prior art, and allows a reduction in the installation spaces, maintenance spaces and equipment costs. Therefore, it has an excellent effect of not causing disadvantages in responding to demands to speed production capacity.

Figure 19:
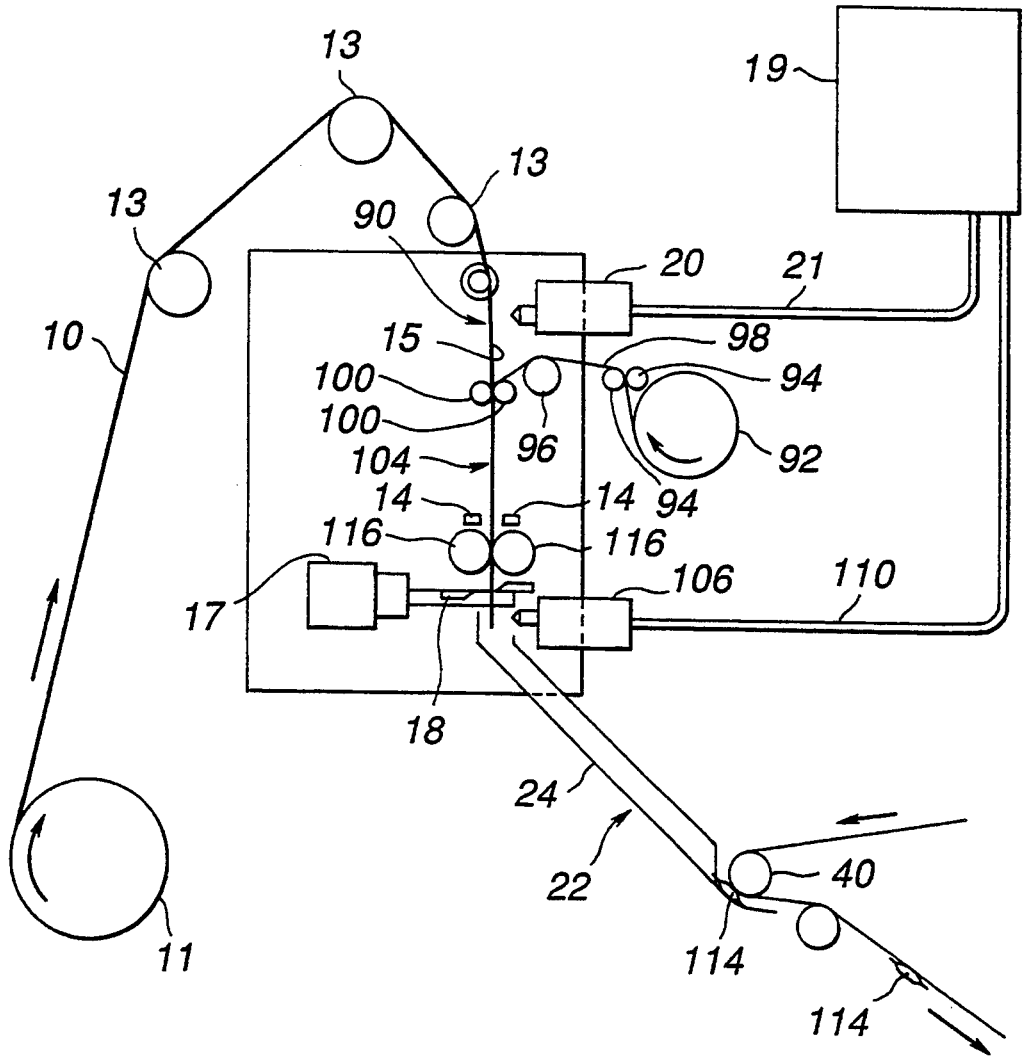
FIG. 19 is a schematic view which illustrates the entire structure of an embodiment for bonding the freshness-keeping-agent bag with the detection agent according to the invention.

The embodiment to bond the freshness-keeping-agent bag with the belt-like member of the detection agents is explained below. FIG. 19 is a schematic view illustrating one embodiment of an apparatus for securing the freshness-keeping-agent bags with the detection agent according to the present invention to the packaging film. In this embodiment, bags containing oxygen absorbers are used as freshness-keeping-agent bags, and an oxygen detection agent is used as detection agent.

In FIG. 19, reference numeral 10 indicates the belt-like member of the bags, each containing an oxygen absorber having the same configuration as the belt-like member of the freshness-keeping-agent bags according to the first embodiment as described above. The belt-like member of oxygen absorber bags is automatically supplied from the roll of the belt-like member of oxygen absorber bags 11, wherein the belt-like member of oxygen absorber bags is wound around a drum to the apparatus explained below through a plurality of the guide rollers 13.

On the belt-like member of oxygen absorber bags 10, a layer of adhesive agent 15 is then formed by continuously or constantly applying hot-melt adhesive on one surface of the belt-like member 10 by using a hot-melt gun 20 that ejects adhesive interlocking with the movement of said belt-like member 10. The hot-melt adhesive is supplied from the hot-melt applicator 19, where the hot-melt adhesive is stored, to the hot-melt gun 20, through a hose 21 connected to the hot-melt gun 20. The hot-melt adhesive used in this embodiment is the same as that used in the first embodiment.

Figure 21:
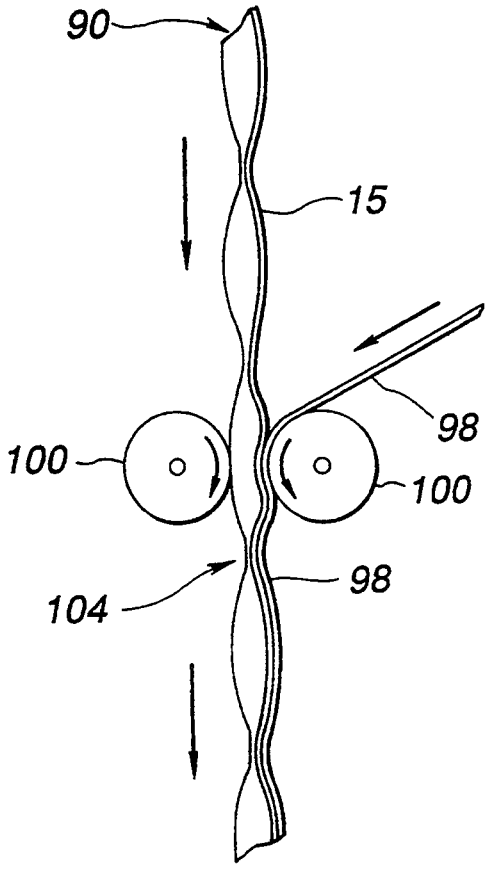
FIG. 21 is a side view which illustrates an example of a step of bonding the belt-like member of the detection agent to the belt-like member of the freshness-keeping-agent bags on which a layer of adhesive agent is formed by compression.
Figure 22:
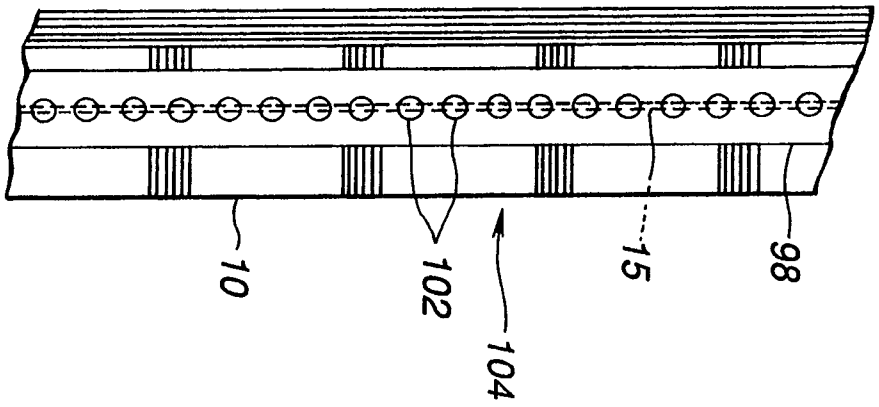
FIG. 22 is a plan view of the belt-like member of oxygen absorber bags with a belt-like member of the detection agent in an embodiment of the invention.
Figure 23:
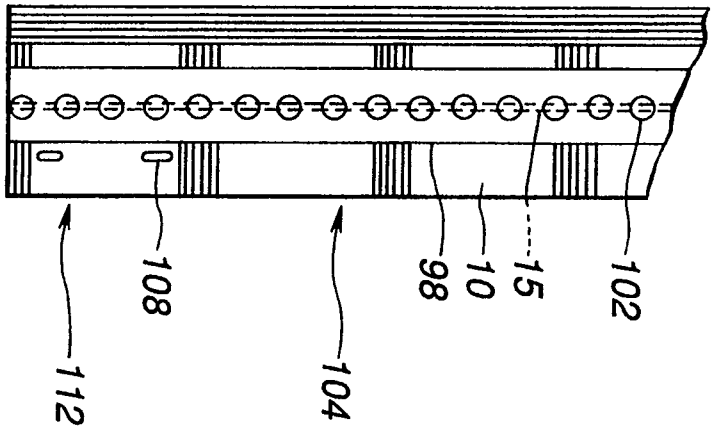
FIG. 23 is a plan view of the belt-like member of oxygen absorber bags with the belt-like member of detection agent on which a layer of adhesive agent is formed at the predetermined position on the belt-like member of oxygen absorber bags according to an embodiment of the invention.
Figure 24:
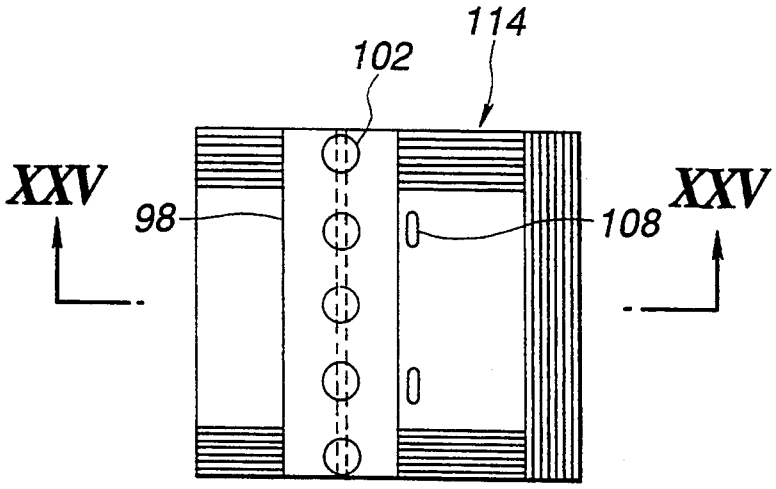
FIG. 24 is a plan view of an individual oxygen absorber bag with detection agent on which a layer of adhesive agent is formed at a predetermined position on the oxygen absorber bag according to an embodiment of the invention.

At the compression roller 100, the belt-like member of oxygen absorber 90, on which a layer of adhesive is formed, is bonded by compression to the belt-like member comprised of detection agent 98 to detect the conditions within the package containing the substance, said agent being formed to extend in a belt-like shape automatically supplied from the roll of the detection agent 92 through the break roller 94 and the detection agent guide roller 96 interlocking with the motion of said belt-like member of oxygen absorber. A sheet of paper or non-woven cloth, on which a compound 102 that changes colors according to the presence of oxygen is printed, applied or immersed, is used as a belt-like member of the detection agents 98 as shown in FIGS. 22, 23, 24. Preferably, the width of the sheet is at least smaller than the width of the oxygen absorber bag. Furthermore, the oxygen detection compound 102 is printed, applied or immersed on the entire surface of the sheet to be used or one portion thereof. The shape thereof may be a rectangle, square, circle, triangle or amorphous. However considering aesthetics and easy discovery, a circle (see FIGS. 22, 23, 24, 26, 27) or square is preferable. As shown in FIG. 21, the belt-like member of bags containing oxygen absorbers with a belt-like member of detection agents 104 is provided as the belt-like member of detection agent 98 and is automatically attached to the adhesive layer of the belt-like member of the freshness-keeping-agent bags 90 on which said adhesive layer 15 is formed through bonding by compression using the compression roller 100. FIG. 22 is a plan view of the belt-like member of bags containing oxygen absorbers with the belt-like member of detection agent 104.

On the belt-like member of oxygen absorber bags with the belt-like member of detection agents 104, the adhesive layer 108 is then formed by applying hot-melt adhesive at a predetermined position on the surface of the belt-like member 104 where the belt-like member of detection agents is attached, by using a hot-melt gun 106 for ejecting adhesive interlocking with the supplying of the belt-like member 104. The hot-melt adhesive is supplied from said hot-melt applicator 19, where the hot-melt adhesive is stored, to the hot-melt gun 106, through the hose 110 connected to the hot-melt gun 106. Preferably, hot-melt adhesive is applied immediately after the temporary stop of the belt-like member 104 when the cutting position of the belt-like member 104 is determined by the detector 14 described below, and immediately before the cutting operation. If only the bag containing the oxygen absorber is secured to the packaging film, the hot-melt gun 106 will not be in operation and the belt-like member of the detection agent 98 will not be set. FIG. 23 shows a plan view of the belt-like member of oxygen absorber bags with the belt-like member of detection agent 112 wherein said adhesive layer is to be formed before the cutting steps.

Figure 25:
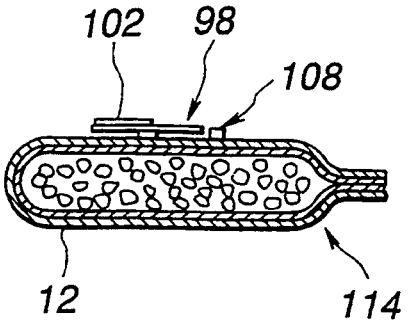
FIG. 25 is a cross-sectional view of FIG. 24 taken along line XXV—XXV.

The cutting position of said belt-like member of bags, each containing oxygen absorbers with the belt-like member of detection agent with adhesive applied thereon 104 or 112 is detected by using the detector 14 which detects the position of the heat-seal portion between each oxygen absorber bag 12 while moving. Once such position is detected, the supply of the belt-like member 104 or 112 is temporarily stopped, upon which the belt-like member 104 or 112 is cut into individual bags, simultaneously with the timing of the production of packages by the packaging machine, by using the cutter 18 operated by the cutter mechanism 17. The adhesive layer is formed immediately before such cutting operation, in the event of the belt-like member 104, on which the adhesive layer is not formed, and the individual oxygen absorber bag with detection agent 114, on which adhesive layer is formed, are provided. In this embodiment, the hot-melt gun 106 is placed immediately below the cutter 18, as shown in FIG. 19. However, the present invention shall not be limited to those embodiments, and the hot-melt gun 106 may be placed at the upper end from the cutter 18. FIG. 24 is the plan view, and FIG. 25 is a cross-sectional view, of the individual bag containing oxygen absorber with detection agent 114 on which the adhesive layer is formed.

The placement of the application or dropping of the hot-melt adhesive is determined depending on the size of each bag containing oxygen absorber, the oxygen detection sheet and the form of the detection agent. Preferably, it is placed at any place other than the heat seal portion within the cutting area. The amount of the hot-melt adhesive to be applied or dropped will be determined depending on the required bonding area based on the size and weight of the bag containing the oxygen absorber, the material of such small bag, and the bond strength of the oxygen detection sheet of the bag and the bond strength of the packaging film. It is preferable to allow the placement and the amount of the hot-melt adhesive to be applied or dropped by being set or adjusted at user's preference. Preferably, the hot-melt guns 20 and 106 may be separately adjustable as to the amount of hot-melt adhesive to be applied or dropped, or the timing of such dropping.

Figure 26:
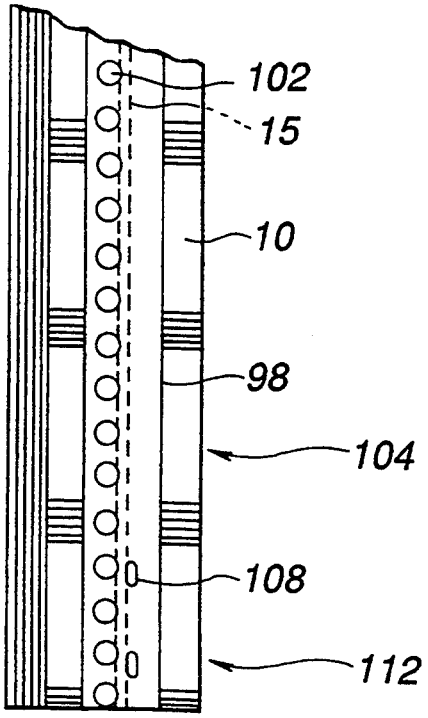
FIG. 26 is a plan view of the belt-like member of oxygen absorber bags with the belt-like member of detection agent on which a layer of adhesive agent is formed at a predetermined position on the surface of the belt-like member of the detection agent according to another embodiment.
Figure 27:
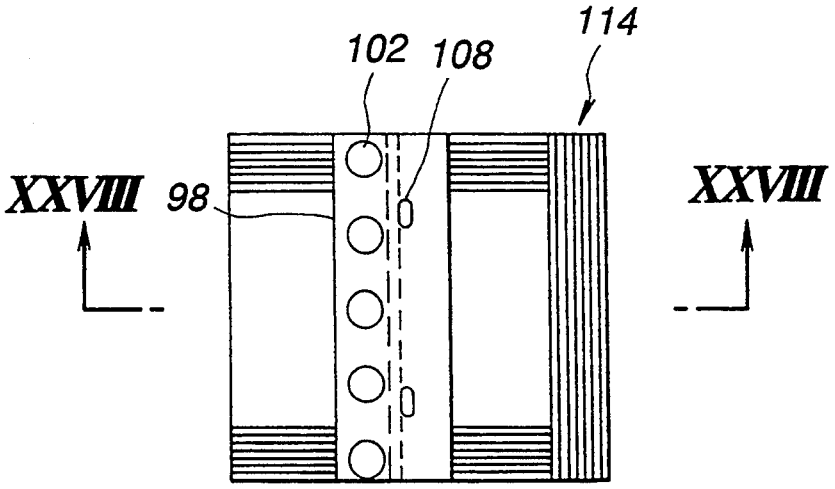
FIG. 27 is a plan view of an individual oxygen absorber bag with detection agent on which a layer of adhesive agent is formed at a predetermined position on the surface of the detection agent according to another embodiment.
Figure 28:
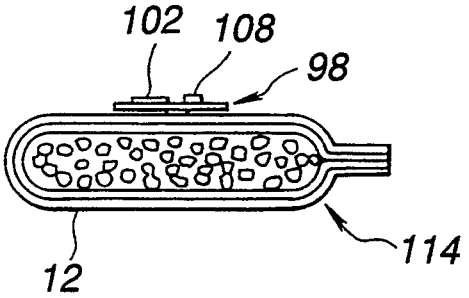
FIG. 28 is a cross-sectional view of FIG. 15 taken along line XXVIII—XXVIII.

In this embodiment, the hot-melt adhesive is applied at a predetermined position on the surface of the belt-like member of oxygen absorber bags 10 in said belt-like member 104, however, it may be applied at a predetermined position on the surface of the belt-like member of detection agent 98 in said belt-like member 104. FIGS. 26, 27 and 28 correspond to FIGS. 23, 24 and 25 in this respect.

Reference numeral 116 in FIG. 19 indicates the supplying roller, which determines the supply of the belt-like member of oxygen absorber bags 10, 90, 104, 112. The supplying roller is provided immediately before the cutter 18.

The individual oxygen absorber bag with detection agent 114 on which an adhesive layer is formed is guided toward the supply line of the packaging film by the guide mechanism 22. The same guide mechanism 22 as that used in the first embodiment is used here, which extends below the temporary bonding roller 40 as in the first embodiment and ends thereat. The distance between the end of the chute 24 and the temporary bonding roller 40 is small enough to enable the bonding of individual bags containing oxygen absorber with detection agent 45, which have been guided to the packaging film supplied through compression by the temporary bonding roller.

Figure 20:
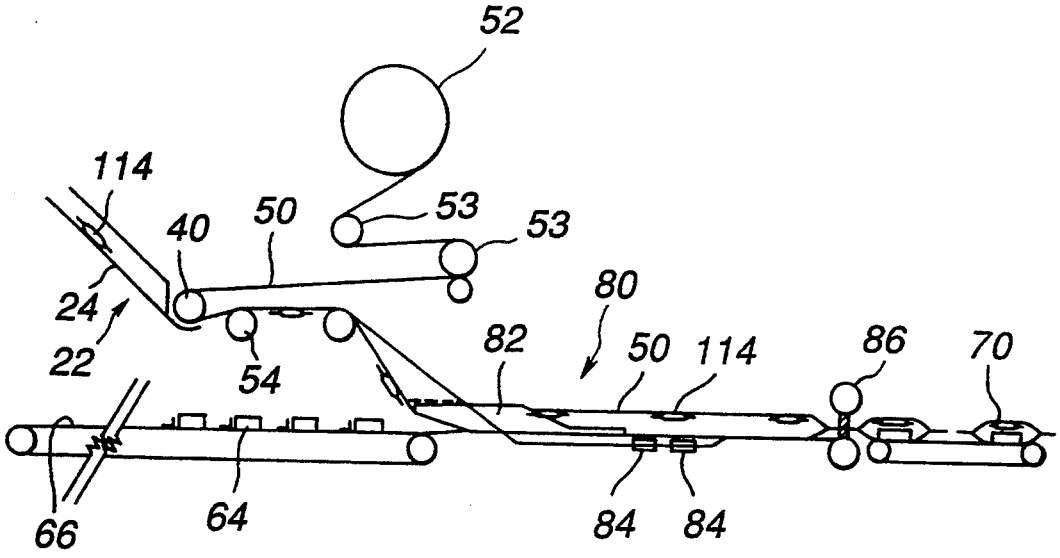
FIG. 20 is a schematic view which illustrates an apparatus for filling a package in a typical side pillow packaging machine of such embodiment.

In FIG. 20, reference numeral 50 indicates the belt-like member of the packaging film that comprises the packaging film extending in the belt-like shape, and is unrolled from the winding roll 52 to which said belt-like member is wound in layers. The belt-like member of the packaging film 50 travels through a plurality of rollers 53 and is rolled at said temporary bonding roller 40. At this place, the bags containing oxygen absorbers with detection agent 114 are secured to the belt-like member of the packaging film at a certain distance, and are closely attached to the belt-like member of the packaging film through a compression roller. Then said packaging film is introduced to the packaging machine 80.

Figure 29:
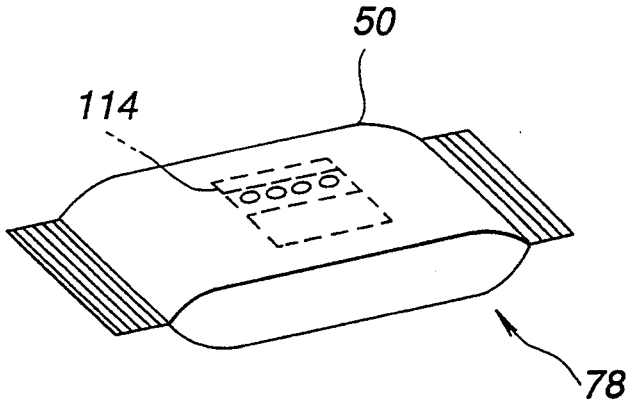
FIG. 29 is a perspective view of the package according to another embodiment.
Figure 30:
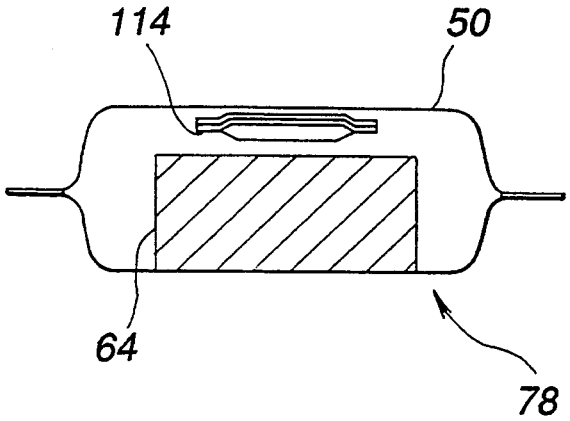
FIG. 30 a cross-sectional view of the package according to another embodiment.

This embodiment shows an example of using the so-called side pillow packaging machine as the packaging machine. The side pillow packaging machine 80 includes the bag producer 82. The belt-like member of the packaging film 50 is folded into a substantially cylindrical shape in the longitudinal direction, which is its axis, and the substance 64, such as foodstuffs, to be supplied by the conveyor 66 is automatically enclosed in the cavity of the packaging film 50 so folded into a cylindrical shape. The center sealers 84 are placed at the downstream side of the bag producer 82 to seal the overlapping portion at the bottom of the packaging film 50 in a cylindrical shape. The top sealer 86 is placed at the downstream side of said center sealer to seal the individual substance 64 into one bag and to cut off such bag at the same time. As shown in FIGS. 28 and 29, the package 70, which is the finished product, has a configuration wherein the substance 64 is accommodated within the bag, both ends of which are sealed, and the individual bag containing oxygen absorber with detection agent 114 is secured to the inside of the packaging film. Furthermore, the detection agent 114 is placed adjacent to the packaging film so that it is visible from the outside. FIG. 29 illustrates the perspective view, and FIG. 30 illustrates the cross-sectional view, of the package 64.

In this embodiment, it is not necessary to stop supplying of the packaging film as in the embodiment shown in FIGS. 7 and 8 because the center sealer 84 continuously seals the center portion along with the supply of the line, and the top sealer 86 moves in synchronization with the movement of the line by drawing a substantially circular arc.

In this embodiment, an oxygen absorber is used as the freshness-keeping agent and an oxygen detector is used as the detection agent. However, the present invention is not intended to be limited to those embodiments, and any other freshness-keeping agents or detection agents may be used. Furthermore, the side pillow packaging machine is used for the above description, however, the present invention is not intended to be limited to those embodiments, and other packaging machines, e.g. reverse side pillow packaging machine in which the center seal portion faces upward in the side pillow packaging machine, or a cup sealer packaging machine as described in the first embodiment, or a deep drawn packaging machine may be used.

According to this embodiment, because the bags containing oxygen absorbers and the detection agent can be automatically secured to the packaging film, the operation of enclosing the freshness-keeping agent and detection agent in the package is simplified. Moreover, because the detection agent and the oxygen absorber bag are integrated, it becomes easier to determine the location of the detection agent within the package, and it prevents accidents such as the consumer eating the detection agent after the package is opened.

What is claimed is:

1. A method for automatically attaching freshness-keeping-agent bags to a belt-like member, comprising:

supplying a belt-like member;

applying adhesive to a plurality of freshness-keeping-agent bags, each containing a freshness-keeping agent;

successively supplying each said bag on which said adhesive has been applied to a supply line of said belt-like member; and pressing each said bag to said belt-like member with said adhesive therebetween.

2. A method according to claim 1, further comprising:

supplying belt-like agent bags in which a plurality of freshness-keeping-agent bags are connected in a belt-like shape; and cutting said belt-like agent bags into individual bags to obtain said plurality of freshness-keeping-agent bags.

3. A method according to claim 1, wherein said belt-like member is a belt-like member of packaging material.

4. A method according to claim 1, wherein said belt-like member is a belt-like member of detection agents to detect the conditions within a package adapted for packaging a substance together with said freshness-keeping-agent bag.

5. A method for packaging a substance, comprising:

supplying a belt-like member of freshness-keeping-agent bags in which a plurality of freshness-keeping-agent bags are connected in a belt-like arrangement;

supplying a belt-like member of packaging material;

applying adhesive to said belt-like member of freshness-keeping-agent bags;

cutting said belt-like member of freshness-keeping-agent bags into individual freshness-keeping-agent bags;

guiding each of said individual freshness-keeping-agent bags toward a supply line of said belt-like member of packaging material;

pressing each of said individual freshness-keeping-agent bags to said belt-like member of packaging material with said adhesive therebetween; and packaging the substance which is separately supplied with said belt-like member of packaging material on which at least one of said freshness-keeping-agent bags is attached.

6. A method according to claim 5, wherein said cutting step is performed after said adhesive applying step.

7. A method according to claim 5, wherein said cutting step is performed before said adhesive applying step.

8. A method according to claim 5, wherein:

each said freshness-keeping-agent bag is temporarily stopped in the midst of said guiding step in order to be synchronized with the timing of said packaging step.

9. A method according to claim 8, wherein said adhesive applying step is performed while each said freshness-keeping-agent bag is temporarily stopped.

10. A packaging method according to claim 5, wherein said packaging step controls the timing of all of the other said steps.

11. A method for packaging a substance, comprising:

supplying a belt-like member of freshness-keeping-agent bags in which a plurality of freshness-keeping-agent bags are in a belt-like arrangement;

supplying a belt-like member of a detection agent for detecting the conditions within a surrounding atmosphere in which a plurality of detection agent is formed in a belt-like arrangement;

applying adhesive to said belt-like member of freshness-keeping-agent bags;

pressing said belt-like member of freshness-keeping-agent bags to said belt-like member of detection agent via said adhesive therebetween; and cutting said belt-like member of freshness-keeping-agent bags with said belt-like member of detection agent into individual freshness-keeping-agent bags with detection agent;

wherein said each freshness-keeping-agent bag with the detection agent is adapted to be enclosed within a package for packaging the substance.

12. A packaging method according to claim 11, further comprising the steps of:

applying a second adhesive to said individual freshness-keeping-agent bags with detection agent;

supplying a belt-like member of packaging material;

guiding each said freshness-keeping-agent bag with detection agent to a supply line of said belt-like member of packaging material;

pressing each said freshness-keeping-agent bag with detection agent to said belt-like member of packaging material with said second adhesive therebetween; and packaging the substance to be separately supplied with the belt-like member of packaging material on which at least one of said freshness-keeping-agent bags with detection agent is attached, so that at least said detection agent is visible from outside of the package.

13. An apparatus for packaging a substance, comprising:

first supplying device for supplying a belt-like member of freshness-keeping-agent bags in which a plurality of freshness-keeping-agent bags are connected into a belt-like arrangement;

second supplying device for supplying a belt-like member of packaging material;

adhesive applicator for applying adhesive to said belt-like member of freshness-keeping-agent bags;

cutter for cutting said belt-like member of freshness-keeping-agent bags into individual freshness-keeping-agent bags;

guide for guiding each said individual freshness-keeping-agent bag toward a supply line of said belt-like member of packaging material;

pressing device for pressing each said freshness-keeping-agent bag to the belt-like member of packaging material via said adhesive therebetween;

packaging device for packaging the substance to be separately supplied with the belt-like member of packaging material on which at least one of said freshness-keeping-agent bags is attached.

14. An apparatus for packaging a substance according to claim 13, wherein said adhesive applicator comprises an adhesive ejector mechanism to eject adhesive onto said freshness-keeping-agent bags.

15. An apparatus for packaging a substance according to claim 13, wherein said cutter is placed at the upstream or downstream side of said ejector mechanism.

16. An apparatus for packaging a substance according to claim 13, wherein said pressing device comprises a compression roller for pressing each of said individual freshness-keeping-agent bags to the belt-like member of packaging material with said adhesive therebetween.

17. An apparatus for packaging a substance according to claim 13, wherein:

a plurality of said guides are arranged in a parallel fashion; and further comprising a sorting device for sorting each of said individual freshness-keeping-agent bags to the respective guides which guides each said freshness-keeping-agent bag toward the supply line of the belt-like member of packaging material.

18. An apparatus for packaging a substance according to claim 13, wherein said guide comprises a chute to cause each said freshness-keeping-agent bag to slide toward the supply line of the packaging material.

19. An apparatus for packaging a substance according to claim 18, further comprising a bag arresting device for temporarily stopping each said freshness-keeping-agent bag on the way down the chute so that the timing of supplying each said freshness-keeping-agent bag is synchronized with the operation of said packaging device.

20. An apparatus for packaging a substance according to claim 18, wherein:

said cutter is positioned at the upstream side of the adhesive applicator; and said adhesive applicator applies adhesive to each said freshness-keeping-agent bag while said bag is temporarily stopped.

21. An apparatus for packaging a substance according to claim 13, wherein said adhesive applicator comprises a dropping mechanism for dropping adhesive onto said freshness-keeping-agent bag while said bag is temporarily stopped.

22. An apparatus for packaging a substance according to claim 18, wherein said chute comprises a sliding surface having lowered friction.

23. An apparatus for packaging a substance according to claim 18, wherein said arresting device comprises a stopper adapted for temporarily stopping said freshness-keeping-agent bags on the way down the chute.

24. An apparatus for packaging a substance according to claim 23, wherein said stopper is a wall raised from the bottom of the chute.

25. An apparatus for packaging a substance according to claim 24, wherein said wall is pivotable on the body of the chute.

26. An apparatus for packaging a substance according to claim 23, wherein said stopper is a movable shutter on the chute.

27. An apparatus for packaging a substance according to claim 18, wherein said chute has a width adjustment mechanism to adjust the width of the chute to the width of the freshness-keeping-agent bag.

28. An apparatus for packaging a substance according to claim 18, wherein said chute comprises a stopper at its end to adjust the position of said freshness-keeping-agent bag to be pressed against said belt-like member of packaging material.

29. An apparatus for packaging a substance according to claim 13 wherein said adhesive application means applies adhesive to said belt-like member of freshness-keeping-agent bags before the freshness-keeping-agent bags are attached to the packaging film.

30. An apparatus for packaging a substance, comprising:

first supplying device for supplying a belt-like member of freshness-keeping-agent bags in which a plurality of freshness-keeping-agent bags are formed into a belt-like shape;

second supplying device for supplying a belt-like member of detection agents for detecting the conditions within a surrounding atmosphere in which a plurality of detection agents are formed into a belt-like shape;

adhesive applicator for applying adhesive to said belt-like member of said freshness-keeping-agent bags;

pressing device for pressing said belt-like member of said freshness-keeping-agent bags to said belt-like member of detection agent with said adhesive therebetween; and cutter for cutting said belt-like member of freshness-keeping-agent bags with said belt-like member of detection agent into individual freshness-keeping-agent bags with detection agent;

wherein said each freshness-keeping-agent bag with the detection agent is adapted to be enclosed within a package for packaging the substance.

31. An apparatus for packaging a substance according to claim 30, further comprising:

second adhesive applicator for applying adhesive to said individual freshness-keeping-agent bags with detection agent;

third supplying device for supplying a belt-like member the packaging material;

guide for guiding each said freshness-keeping-agent bag with detection agent to a supplying line of said belt-like member of packaging material;

second pressing device for pressing each said freshness-keeping-agent bag with detection agent to said belt-like member of packaging material via said second adhesive layer therebetween; and packaging device for packaging the substance to be separately supplied with the belt-like member of packaging material on which at least one of said freshness-keeping-agent bags with detection agent is attached.

* * * * *